US006106143A

United States Patent [19]

Nickel et al.

[11] Patent Number: 6,106,143

[45] Date of Patent: Aug. 22, 2000

[54] VIBRATING DEVICE FOR VIBRATING LIQUID PROVIDED IN VESSELS

[75] Inventors: Jens-Peter Nickel, Helsa; Wolfgang Rietschel, Soehrewald; Rainer Sandrock, Kassel, all of Germany

[73] Assignee: B. Braun Biotech International GmbH, Melsungen, Germany

[21] Appl. No.: 09/246,711

[22] Filed: Feb. 9, 1999

[30] Foreign Application Priority Data

Mar. 28, 1998 [DE] Germany ..... 198 14 013

[51] Int. Cl.[7] ..... B01F 11/00

[52] U.S. Cl. ..... 366/128; 74/61

[58] Field of Search ..... 366/108, 110, 366/111, 112, 114, 115, 128, 209, 210, 211; 74/61, 571 L

[56] References Cited

U.S. PATENT DOCUMENTS 5,134,893 8/1992 Hukki et al. ..... 366/128
5,396,815 3/1995 Polites et al. ..... 74/61
5,496,167 3/1996 Diaz ..... 74/61
5,558,437 9/1996 Rode ..... 366/208

FOREIGN PATENT DOCUMENTS 1507435 9/1989 U.S.S.R. ..... 366/128

*Primary Examiner*—Tony G. Soohoo
*Attorney, Agent, or Firm*—Diller, Ramik & Wight, PC

[57] ABSTRACT

A vibrating device for vibrating liquid provided in vessels comprises a vibrating table (32) whereon the vessels are mountable. The vibrating table (32) is supported eccentrically on a flywheel (10). Due to the eccentric support of the vibrating table (32) on the flywheel (10), high centrifugal forces occur during the operation of the vibrating device, deteriorating the stability of the vibrating device. According to the invention, an adjustable counterbalance weight (76) is connected to the flywheel (10) for balancing the centrifugal forces occurring. For adjustment purposes, the counterbalance weight (76) can be shifted along a guiding device (78). The guiding device (78) comprises a guiding spindle (80) whereon a threaded adjusting nut (87) is provided. By rotating the adjusting nut (87) by means of an adjusting wrench (88), the counterbalance weight (76) can be shifted in the guiding device (78) radially to the flywheel (10).

10 Claims, 2 Drawing Sheets

88
89
92
90
21
II
60
76
87
85
86
85
84
80
84
78
62
46
12
52
14
10
62
46
26
60
30
93
II

VIBRATING DEVICE FOR VIBRATING LIQUID PROVIDED IN VESSELS

BACKGROUND OF THE INVENTION

The present invention refers to a vibrating device for vibrating liquid contained in vessels. By vibrating the vessels, for example, the liquid provided in the vessels is mixed or the surface of the liquids enlarged to improve the oxygen reception of the liquid.

Such vibrating devices comprise a vibrating table whereon the vessels can be secured. The vibrating table is mounted eccentrically on a flywheel, which is driven, for example, by means of a belt drive. Due to the eccentric circular movement of the vibrating table in combination with the vessels arranged thereon, centrifugal forces occur. The centrifugal forces occurring reduce the stability of the vibrating device.

It is possible to provide a counterbalance weight arranged eccentrically to the rotational axis of the flywheel to compensate for the centrifugal forces acting thereupon. As such a counterbalance weight causes an exactly determined centrifugal force, only a specific mass to be vibrated can be balanced by the counterbalance weight, which mass, together with the vibrating table, causes a centrifugal force having the same amount. Once the mass to be vibrated is increased or reduced, it causes a centrifugal force differing from the centrifugal force caused by the counterbalance weight so that vibrations are caused in the vibrating device, which reduce the stability of th e vibrating device. U.S. Pat. 5,558,437 describes a vibrating device having an eccentrically mounted vibrating table. Counterbalance weights are mounted on an arm connected with the rotating shaft of the vibrating table to balance the centrifugal forces occurring due to the mass to be vibrated. To balance different centrifugal forces, the counterbalance weights mounted on the arm can be exchanged against counterbalance weights of different sizes.

SUMMARY OF THE INVENTION

It is the object of the invention to improve the stability of a vibrating device even in the case of masses to be vibrated of different sizes.

The invention refers to a vibrating device for vibrating liquid provided in vessels, comprising a vibrating table whereon the vessels are mountable, a driven flywheel whereon the vibrating table is supported eccentrically and a counterbalance weight arranged on the flywheel for compensating centrifugal forces, wherein the counterbalance weight is continuously shiftable radially to the flywheel along a guiding device and is adjustable according to the mass to be vibrated.

According to the invention, a counterbalance weight is arranged on the flywheel, which counterbalance weight can be adjusted according to the size of the mass to be vibrated. For this purpose, the counterbalance weight can be shifted radially to the flywheel along a guiding device. By changing the distance between the counterbalance weight and the rotational axis of the flywheel, the size of the centrifugal force to be caused by the counterbalance weight is changeable. The larger the mass to be vibrated, the further the counterbalance weight is moved outwards along the guiding device relative to the rotational axis of the flywheel. Thus, it is possible to compensate fully for the centrifugal force caused by the mass to be vibrated. This significantly increases the stability, even in the case of different masses to be vibrated, as the position of the counterbalance weight can be adjusted before each vibrating operation.

The counterbalance weight compensates for the entire mass to be vibrated, i.e., the mass of the vibrating table, the vessels, the liquid and possibly additional objects fixed to the vibrating table. Two counterbalance weights can also be provided, one counterbalance weight being fixed to the flywheel and compensating the invariable mass of the vibrating table. The second counterbalance weight is shiftable radially to the flywheel and balances the variable mass of the liquid, the vessels and the like. Furthermore, it is possible to fix an additional weight to the shiftable counterbalance weight, which additional weight is shiftable together with the counterbalance weight to balance larger centrifugal forces.

As a guiding device, a dovetail guide having a groove extending radially to the rotational axis of the flywheel and having an appropriate clamping device can be provided.

Preferably, the guiding device comprises a spindle arranged essentially vertically to the rotational axis, whereon the counterbalance weight is shiftable in a longitudinal direction. To shift the counterbalance weight on the spindle, the counterbalance weight can comprise a threaded bore so as to be shiftable by rotating. A change of the position of the counterbalance weight during the vibrating process is avoided by the nonreversibility of the thread. The counterbalance weight can also comprise a through hole without a thread through which hole the guiding spindle is guided. In this case, the guiding spindle is supported in a tapped hole in the flywheel so that the position of the counterbalance weight is changeable by rotating the guiding spindle.

To improve the stability and to adjust the position of the counterbalance weight relative to the flywheel as exactly as possible, the guiding spindle is preferably connected nonrotatingly to the flywheel. The counterbalance weight comprising a through hole without a thread is shiftable by rotating an adjusting nut on the guiding spindle.

An adjusting wrench can be applied onto the adjusting nut for rotating it. The adjusting wrench comprises a shaft with a scale arranged in the longitudinal direction thereof. The current position of the counterbalance weight relative to the rotational axis of the flywheel can be read from the scale. This can be used to calculate the centrifugal force caused by the counterbalance weight as well as the mass to be vibrated, which is compensated for by the current position of the counterbalance weight. Preferably, the weight of the mass to be vibrated is marked directly on the scale so that the mass to be compensated for by the position of the counterbalance weight can be read directly on the adjusting wrench.

In a process for vibrating the liquid provided in the vessels, the weight of a load to be arranged on the table is determined first. The load includes the weight of all the vessels and the liquids contained therein as well as possibly the weight of a platform supporting the vessels. It is not required to determine the mass of the vibrating table, as it is known and remains unchanged. After the weight of the load has been determined, the distance of the counterbalance weight to the rotational axis of the flywheel is adjusted according to the size of the load by radially and continuously displacing the counterbalance weight.

Preferably, the distance of the counterbalance weight is adjusted by means of the adjusting wrench having a scale, the weight of the load corresponding to the position of the counterbalance weight being readable on the scale depending on the position of the adjusting wrench.

BRIEF DESCRIPTION OF THE DRAWINGS

There now follows a more detailed description of a preferred embodiment of the invention with reference to the accompanying drawings.

DESCRIPTION OF THE PREFERRED EMBODIMENTS

Figure 1:
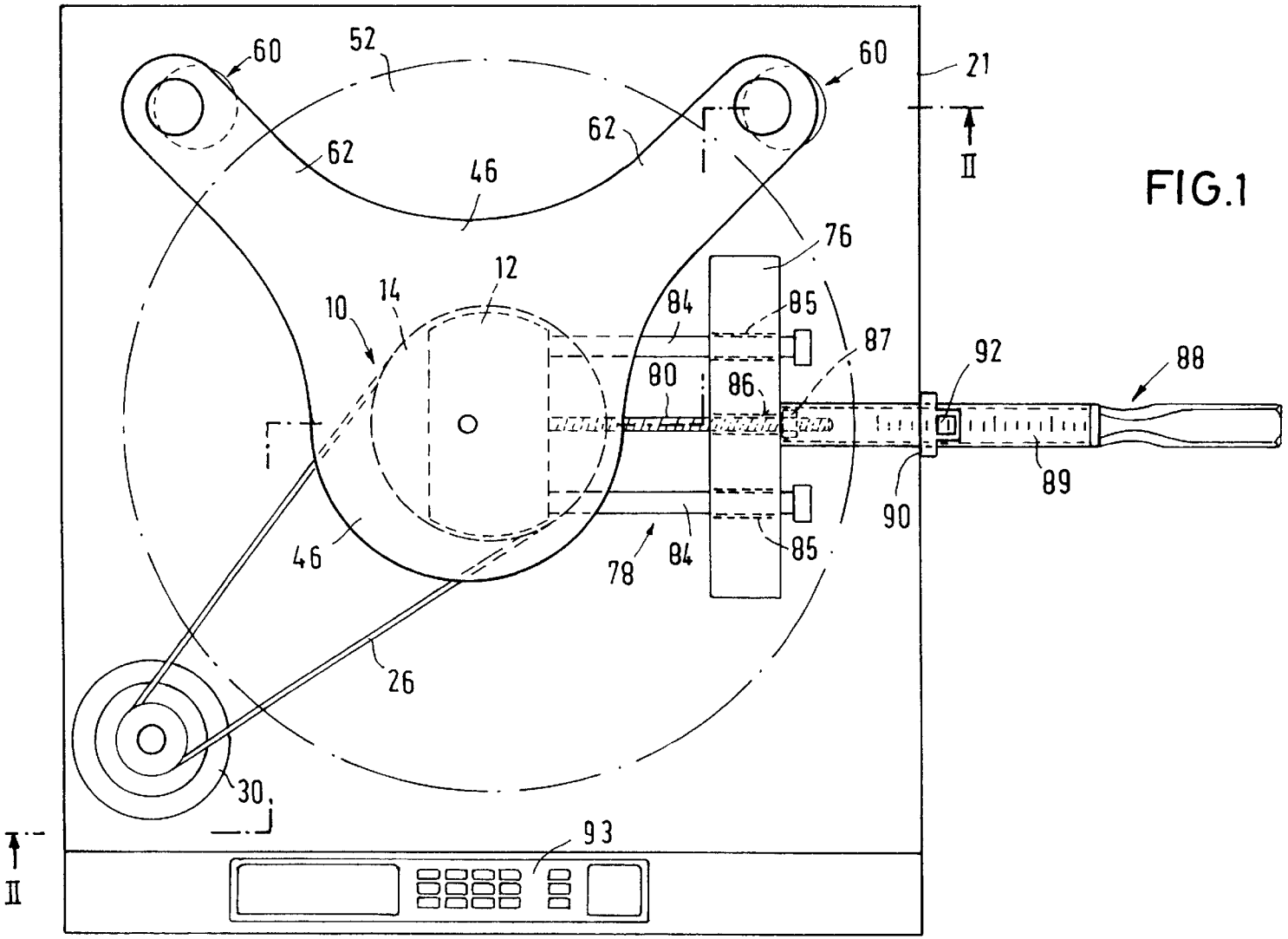
FIG. 1 shows a diagrammatic top plan view of the vibrating device according to the invention.

The vibrating device comprises a flywheel 10 comprising a fly-wheel base 12 and a cylindrical flywheel hub 14. The flywheel 10 is rotatingly supported on a bearing neck 18 by means of bearings 16. The bearing neck 18 is mounted on a base plate 20 of a housing 21 of the vibrating device. Feet 22 are mounted on the base plate 20 to ensure a safe position of the vibrating device on a table.

In the cylindrical hub 14 of the flywheel 10, circumferential grooves 24 are provided in which belts 26 are guided. The belts 26 are connected to a driving shaft 28 of an electromotor 30. Instead of multiple belts 26, a ripped cone belt having multiple grooves can be used.

A vibrating table 32 is connected nonrotatingly to the fly-wheel 10. For this purpose, a bearing neck 36 is supported nonrotatingly in a recess 34 of the cylindrical hub 14 of the flywheel 10. A cylindrical hub 38 of greater diameter is connected to the bearing neck 36 arranged in the recess 34. A centering neck 40 concentric to the bearing neck 36 is provided on the cylindrical hub. The centering neck 40 is received in a bore 42 in the flywheel 10. To produce a greater stroke, the cylindrical hub 38 in FIG. 1 can be shifted to the left. The centering hub 40 is then received in a bore not represented and corresponding to the bore 42. To avoid a rotation of the bearing neck 36 relative to the flywheel 10, the cylindrical hub 38 is connected to the flywheel 10 by means of an eccentricly arranged screw 44.

A vibrating table base 46 of the vibrating table 32 is supported by bearings 48 in a freely rotatable manner on the bearing neck 36. A vibrating table support 52 is fixedly connected on the vibrating table base 46 by means of screws 50.

On the vibrating table support 52, a platform 54 is mounted on which the vessels with the liquid to be vibrated are mounted. The platform 54 is mounted on the vibrating table support 52 by means of mounting pins 56 and springs 58. Thereby, it is possible to mount the platform 54 quickly and in a simple manner onto the vibrating table 32 or take it off the vibrating table 32. Thus, platforms 54 can be exchanged quickly.

To improve the vibration of the liquid provided in the vessels, the rotation of the vibrating table 32 according to the flywheel 10 has to be avoided. If the vibrating table 32 rotated with the flywheel 10, no rotation would take place between the vibrating table 32 and the flywheel. Thus, the direction of the centrifugal force acting upon each vessel would not change, and the liquid provided in the vessels would not be vibrated accordingly. To avoid a rotation of the vibrating table 32, a distorsion lock 60 is provided between the vibrating table 32 and the base plate 20.

Figure 2:
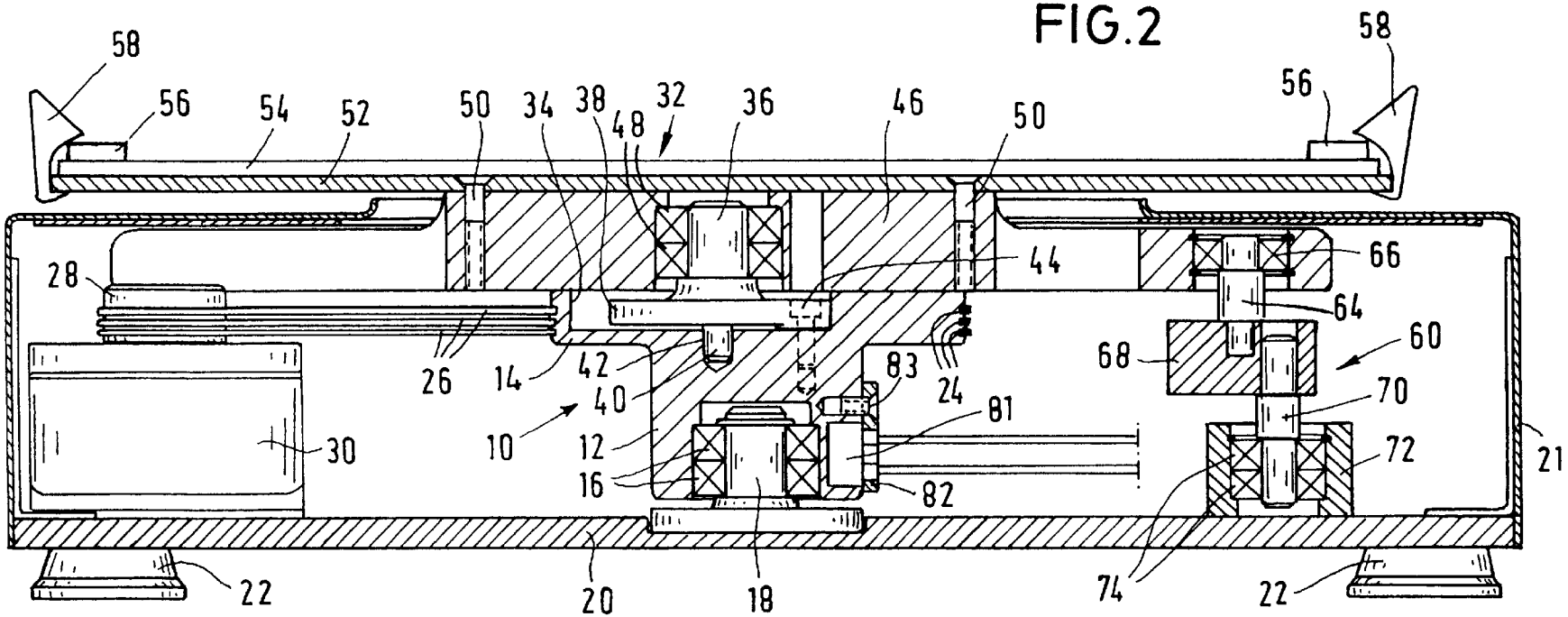
FIG. 2 shows a diagrammatic sectional view along line II—II in FIG. 1.

To arrange the distorsion lock 60 in a convenient manner, the vibrating table base 46 of the vibrating table 32 comprises two arms 62 extending radially to the outside and being offset at about 90°. On the exterior end of the arms 62, a first bearing neck 64 (FIG. 2) is supported rotatingly 66 by means of bearings 66. The bearing neck 64 is connected nonrotatingly to an intermediate part 68 in which a second bearing neck 70 is supported nonrotatingly and eccentricly to the first bearing neck 64. The second bearing neck 70 is again supported rotatingly in the cylindrical hub 72 by means of bearings 74. The cylindrical hub 72 is connected fixedly to the base plate 20.

Due to the eccentric arrangement of the vibrating table 32 in the flywheel 10 and the two distorsion locks 60 connected to the vibrating table, the vibrating table 32 and the vessels arranged thereon are moved on a circular course when the vibrating device is operated, the direction of the vibrating table 32 being maintained. Thus, the direction of the centrifugal forces acting upon the vessels is changed so that the liquid provided in the vessels is vibrated well.

To balance the centrifugal forces caused by the eccentric movement of the mass to be vibrated, a counterbalance mass 76 (FIG. 1) is connected to the flywheel base. However, to be able to compensate for different loads of the vibrating table 32, i.e. different amounts of liquid to be vibrated, different vessel weights as well as different weights of the platform 54 and the varying centrifugal forces caused thereby, the counterbalance weight 76 is shiftable radially to the flywheel 10. For this purpose, a guiding device 78 is provided. The guiding device 78 comprises a guiding spindle 80 arranged radially to the flywheel 10. The end of the guiding spindle 80 directed towards the flywheel 10 comprises a rotation lock 81 received in a complementary recess of the flywheel base 12 and avoiding a rotation of the guiding spindle 80. The guiding spindle 80 is supported by a plate 82 and three screws 83 and is fixedly connected to the flywheel base 12.

In parallel to the guiding spindle 80, two guiding rods 84 are also connected to the flywheel base 12. The counterbalance weight 76 comprises two through bores 85 through which the guiding rods 84 are guided, and one through bore 86 through which the guiding spindle 80 is guided. The counterbalance weight 76 can thus be shifted radially to the flywheel 10. By changing the distance between the rotational axis of the fly-wheel 10 and the counterbalance weight 76, the centrifugal force caused by the counterbalance weight 76 is changeable.

To adjust the position of the counterbalance weight 76, an adjusting nut 87 having an interior weight is provided on the guiding spindle. By rotating the adjusting nut 87, the distance between the counterbalance weight 76 and the rotational axis of the flywheel 10 is adjustable. To move the counterbalance weight 76 to the right in FIG. 1 together with the adjusting nut 87 when increasing the distance, the adjusting nut 87 can be connected to a carrier sleeve. The carrier sleeve can comprise an interior thread and be supported rotatingly in the counterbalance weight 76. To ensure a defined adjustment of the counterbalance weight 76 in both directions, the carrier sleeve comprises a shoulder on one side and a securing ring on the opposite side.

An adjusting wrench 88 is provided for adjusting the adjusting nut 87, which wrench can be slid onto the adjusting nut 87. If the adjusting nut 87 is a hexagon nut, the adjusting nut 88 comprises a corresponding interior hexagon. A shaft 89 of the adjusting wrench is formed to be hollow so that the adjusting wrench 88 can also be slid onto the guiding spindle 80 when the difference between the counterbalance weight 76 and the rotational axis of the flywheel 10 is small. To be able to slide the adjusting wrench 88 onto the adjusting nut 87, an opening 90 is provided in the housing 21, through which opening the adjusting wrench 88 can be inserted into the housing 21.

A guiding sleeve 91 is provided in the opening 90 to ensure that the adjustment wrench 88 is slid onto the adjusting nut 87. A scale is provided on the shaft 89 of the adjusting wrench 88. The guiding sleeve 90 provides a view window 92 through which the scale can be read. As the position of the adjusting wrench changes depending on the position of the counterbalance weight 76 on the guiding spindle 80, the position of the counterbalance weight 76 can be read because of the scale mark visible in the view window. The scale can either display the distance between the counterbalance weight 76 and the rotational axis of the flywheel 10 or the mass to be vibrated balanced by the adjusted position of the counterbalance weight 76. The mass to be vibrated is either the entire mass to be vibrated or only the weight of the platform 54 together with the vessels and the liquid provided therein.

When the vibrating device is used, the platform 54 is at first weighed together with the vessels mounted thereon and the liquid provided therein. Then the distance of the counterbalance weight 76 to the rotational axis of the flywheel 10 is adjusted by means of the adjusting wrench 88. To be able to slide the adjusting wrench 88 onto the adjusting nut, the guiding spindle 80 has to be in alignment with the opening 90 in the housing 21. As the housing 21 is closed, a position transmitter has to be provided on the flywheel to move the flywheel into the rotational position in which it is possible to apply the adjusting wrench 88 on the adjusting nut for adjusting the counterbalance weight. For this purpose, a mark can be provided, for example on the flywheel, which mark is visible through a view window arranged in the housing 21 and marks the rotational position of the flywheel. An electric position transmitter can also be provided on the flywheel so that the rotational position required to apply the adjusting wrench can be determined electrically. Thus, only a determined signal has to be input via a keyboard 93 on a display field 94 for adjusting the required rotational position so that the counterbalance weight 76 is automatically turned into a position in which the guiding spindle 80 is aligned with the opening 90 in the housing 21 and the adjusting wrench 88 can be slid on. Furthermore, the desired rotational speed of the fly-wheel 10 can be input via the keyboard 93 of the display field 94 and is adjustable to between 40 and 400 revolutions per minute.

What is claimed is:

1. Vibrating device for vibrating liquid provided in vessels, comprising a vibrating table (32) whereon the vessels are mountable, a driven flywheel (10) whereon the vibrating table (32) is supported eccentrically and a counterbalance weight (76) arranged on the flywheel (10) for compensating centrifugal forces, wherein the counterbalance weight (76) is continuously shiftable radially to the flywheel (10) along a guiding device (78) and is adjustable according to the mass to be vibrated.

2. Vibrating device according to claim 1, wherein the guiding device (78) comprises a guiding spindle (80) arranged essentially vertically to the rotational axis of the flywheel (10), on which guiding spindle the counterbalance weight (76) is shiftable in a longitudinal direction.

3. Vibrating device according to claim 2, wherein the guiding spindle (80) is nonrotatingly connected to the flywheel (10) and the counterbalance weight (76) is shiftable by rotating an adjusting nut (87) on the guiding spindle (80).

4. Vibrating device according to claim 3, wherein an adjusting wrench (88) can be slid on for rotating the adjusting nut (87), which wrench comprises a shaft (84) having a scale arranged in a longitudinal direction for adjusting the position of the counterbalance weight (76) depending on the mass to be vibrated.

5. Vibrating device according to claim 4, wherein a position transmitter is connected to the flywheel (10), which position transmitter indicates when the counterbalance weight (76) is located in a determined rotational position allowing the application of the adjusting wrench (88).

6. Vibrating device according to claim 2, wherein at least one guiding rod (84) is provided in parallel to the guiding spindle (80) for stabilizing the position of the counterbalance weight (76).

7. Vibrating device according to claim 1, wherein a distorsion lock (60) is provided between the vibrating table (32) and a base plate (30).

8. Vibrating device according to claim 1, wherein a platform (54) supporting the vessels is mounted on the vibrating table (32).

9. Process for vibrating liquid provided in vessels by means of a vibrating device according to claim 1, wherein the weight of a load to be arranged on a vibrating table (32) is determined and the distance of the counterbalance weight (76) to the rotational axis of the flywheel (10) is adjusted depending on the size of the load by means of a radial continuous shift of the counterbalance weight (76).

10. Process according to claim 9, wherein adjusting the distance of the counterbalance weight (76) is performed by means of an adjusting wrench (88) with a scale, the weight of the load corresponding to the position of the counterbalance weight (76) being readable on the scale according to the position of the adjusting wrench (88).

* * * * *